United States Patent [19]

Metcalfe et al.

[11] 4,046,596

[45] Sept. 6, 1977

[54] PROCESS FOR PRODUCING SPECTACLE FRAMES USING AN AGE-HARDENABLE NICKEL-BRONZE ALLOY

[75] Inventors: Richard T. Metcalfe; George A. Granitsas, both of Sturbridge, Mass.; Edgar H. Elliott, Woodstock, Conn.

[73] Assignee: American Optical Corporation, Southbridge, Mass.

[21] Appl. No.: 591,189

[22] Filed: June 27, 1975

[51] Int. Cl.[2] ..... C22F 1/08; G02C 13/00

[52] U.S. Cl. ..... 148/2; 75/154; 75/156; 75/156.5; 75/157; 148/12.7 C; 148/32.5; 148/127; 148/160

[58] Field of Search ..... 148/127, 160, 2, 12.7 C, 148/32, 32.5, 34; 75/154, 156, 156.5, 157; 29/20

[56] References Cited

U.S. PATENT DOCUMENTS 2,117,106 5/1938 Silliman ..... 148/127

*Primary Examiner*—R. Dean

*Attorney, Agent, or Firm*—H. R. Berkenstock, Jr.; William C. Nealon

[57] ABSTRACT

There is disclosed a process for the production of a spectacle frame high in tensile strength and resistance to permanent set utilizing an age-hardenable nickel-bronze alloy which is capable of being strengthened by a heat-aging treatment step such that the tensile strength and stiffness can be substantially increased. The tendency for the frame to take a permanent set with the application of stress to the frame is, therefore, substantially reduced as compared to a similar spectacle frame not subjected to a heat-aging treatment step or spectacle frames made of alloys which cannot be strengthened by a heat-aging treatment.

5 Claims, 1 Drawing Figure

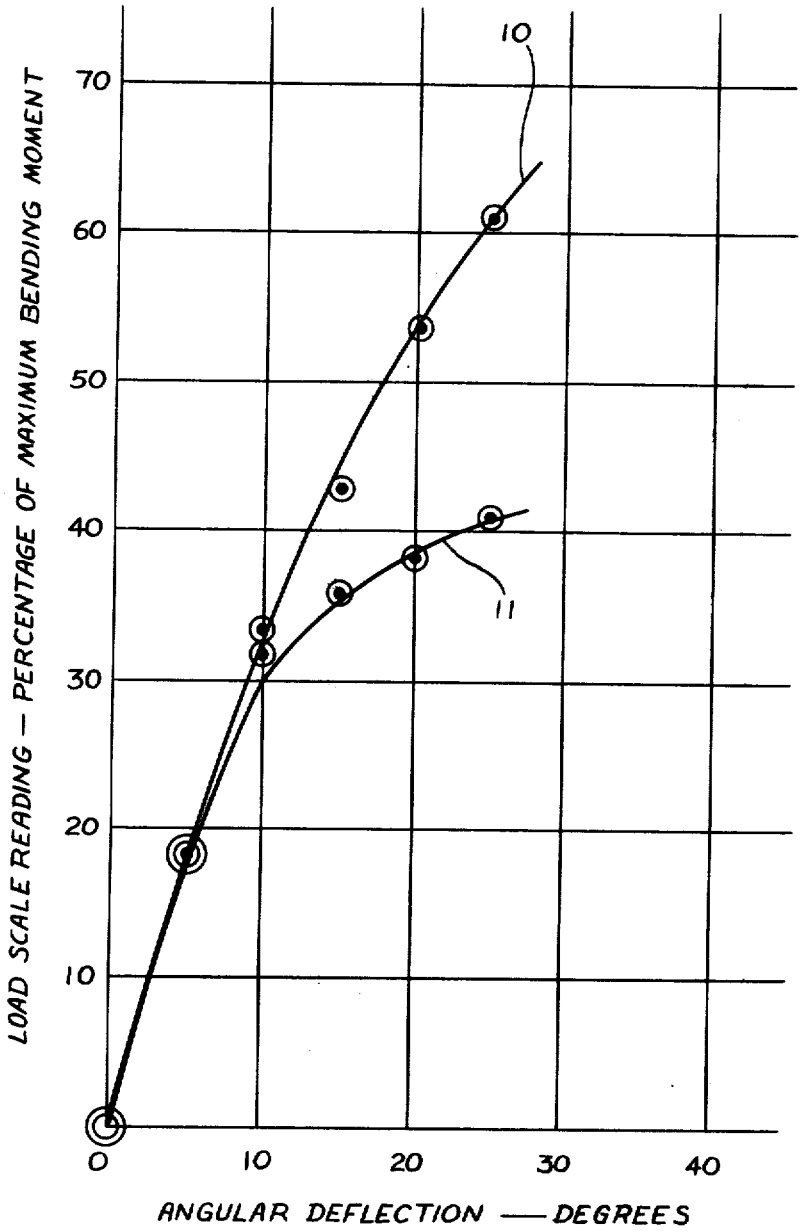
LOAD SCALE READING — PERCENTAGE OF MAXIMUM BENDING MOMENT
70
60
50
40
30
20
10
0
10
20
30
40
ANGULAR DEFLECTION — DEGREES
10
11

PROCESS FOR PRODUCING SPECTACLE FRAMES USING AN AGE-HARDENABLE NICKEL-BRONZE ALLOY

BACKGROUND OF THE INVENTION

1. Field of the Invention

The invention is in the field of metallic spectacle frames.

2. Description of the Prior Art

Nickel-bronze alloys of copper which can be strengthened or age-hardened by exposure to a temperature substantially below the melting point of the alloy are known in the prior art for use in such applications as bearings, valves, pumps and springs. The properties of these materials are discussed by Eash et al. in an article entitled "The Copper-Rich Alloys of the Copper-Nickel-Tin System" in the transactions of AIME, 1933, Vol. 104, pages 221–249, and by Wise et al. in an article entitled "Strength and Aging Characteristics of the Nickel Bronzes" in the transactions of the AIME, 1934, Vol. 111, pages 218–244 and additionally in U.S. Pat. Nos. 1,816,509 and 1,928,747.

The process of hardening such alloys by subjecting, for instance, castings to elevated temperatures such as at temperatures above 316° C over a period of about 5 hours is described as a means of "precipitation hardening" resulting in a change in the alpha domain in the alloy.

Recently, Plewes in *Metallurgical Transactions*, Vol. 6A for March 1975, pages 537–544, has found that prior cold work performed on copper-nickel-tin alloys affects the characteristics of such alloys which are subsequently age-hardened at elevated temperatures. Applications for such high strength copper based alloys disclosed by Plewes are connectors, diaphragm members and spring components in electromechanical relay packages. In work with a copper alloy containing 9 percent by weight nickel and 6 percent by weight tin, Plewes found that the minimum level of prior cold work required to effect the desired critical competitive balance between ductile/brittle properties is 75 percent reduction in area.

The majority of prior art spectacle frames are made of a non-heat-treatable or age-hardenable material such as pure nickel, Monel or the so called "nickel silver" which is an alloy of copper, nickel and zinc containing 10 to about 30 percent nickel and 5–33 percent zinc. In the process of producing the desired gage or diameter wire useful in such eyeglass frames, it is customary to cold work the wire alloy utilized, subjecting the alloy to a drawing operation to produce about 10 percent to about 75 percent reduction in area prior to assembling the frame in the desired shape and brazing the joints and other reinforcing parts of the frame. During the brazing operation which can be performed utilizing, for instance, electrical resistance heating, the spectacle wire frame is heated to a temperature of about 600° C to about 750° C to melt the brazing material utilized to effect the joint. In the process of heating the spectacle components, those components in the immediate vicinity of the joint tend to partially anneal with the result that the finished frame has weak spots at the brazed joints and marginal resistance to bending. As a result, the prior art frames have marginal resistance to bending and too easily acquire a permanent set subsequent to the application of stress to the frame such that the proper fit of said spectacles to the head of the wearer is not retained over a substantial portion of the life of the spectacle frame necessitating frequent readjustment of such frames. The fact that the metal spectacle frames of the prior art are made utilizing a material which cannot be increased in tensile strength or hardness subsequent to the brazing operation during assembly in which the frame is softened, results in a spectacle frame having weak areas specifically at the brazed areas.

It is known that beryllium copper alloys which also can contain nickel or cobalt have high strength and hardness and are useful as alloys in optical applications such as spectacle frames. A typical alloy analysis is as follows: beryllium 2.25 percent, nickel 0.35 percent and balance copper. Such alloys can be hardened by heat treatment but usage of such alloys in spectacle frames has been limited by the difficulty of successfully brazing such alloys in the assembly of spectacle frames because of beryllium content. The alloy tends to form a very adherent and refractory oxide of beryllium which makes the alloy difficult to pickle and braze as well as electroplate.

Heat-treatable alloys of Inconel and strainless steel of the 200 and 400 series are also subject to similar difficulties in the assembly of spectacle frames as noted above for beryllium copper alloys. In addition, the high yield points of these alloys make these alloys difficult to process and the annealing temperatures of these alloys are at least one hundred degrees centigrade higher than the nickel bronzes and thus more expensive annealing ovens would be required to utilize Inconel and stainless steel alloys.

SUMMARY OF THE INVENTION

There is provided a process for the production of a spectacle frame having substantially increased tensile strength and resistance to permanent set. A heat-treatable nickel-bronze alloy has been found to provide a substantially stronger spectacle frame as compared to frames of the prior art since such alloys of copper as are disclosed for use in the process of the invention can be strengthened by an heat-aging treatment subsequent to assembly and partial annealing of said frames during brazing. By the process of the invention, spectacle frames are hardened by heat-aging at a temperature substantially below the melting point of the alloy or brazing material utilized. In this way, the strength of the alloy is increased by a mechanism involving precipitation of a phase within the copper alloy corresponding, for instance, in an alloy containing nickel and tin to a phase of the compound $Ni_2Sn$.

Suitable copper alloys comprise those containing nickel and tin in the amounts by weight of about 2 percent to about 10 percent tin and about 3 percent to about 26 percent nickel.

DESCRIPTION OF THE DRAWING

In the drawing, there is shown the results obtained upon evaluation of the stiffness of a series of spectacle eyewire frames (front portion) made without a brace. Each point on the curve 10 represents the results of an average of 5 determinations of stiffness on spectacle fronts prepared according to the process of the invention disclosed in Example 6. Comparable results for a spectacle front prepared according to the procedure of control Example 7 are shown in curve 11 which is representative of the stiffness of prior art spectacle eyewire frame front portions.

The spectacle eyewire frame front portions evaluated above are tested to the point where permanent set is acquired by the sample under test. For the frame front of Example 6, permanent set of 8° 15' was acquired after deflection through 25°. For the frame of control Example 7 (representative of the prior art), a permanent set of 14° was acquired after deflection through 25°.

The determinations were made using a Tinius Olsen stiffness tester utilizing a 2 inch span and an 8 inch-pound load. In the graph shown in the drawing, angular deflection is shown on the abscissa, or $x$ axis and percentage of maximum bending moment in shown on the ordinate, or $y$ axis.

The results obtained indicate a substantial increase in strength and resistance to permanent set can be achieved in a spectacle frame by use of a copper, nickel, tin alloy, said alloy being capable of being hardened by heat-aging.

DESCRIPTION OF THE PREFERRED EMBODIMENTS

There is provided a process for the production of spectacle frames having improved ultimate strength and resistance to permanent set as compared to prior art eyeglass frames. By the process of the invention, a nickel-bronze alloy is utilized to prepare an eyeglass frame, the frame being assembled by brazing. In the process of the invention, the frame joints are heated to a temperature at which the brazing alloy such as a silver-containing brazing alloy melts. The heating of the frame for the brazing operation can be any heating method such as resistance, induction, or furnace heating. The later two methods of heating offer advantages in processing since a frame for a spectacle can be thereby produced with less labor by heating the entire frame assembly rather than only the joint portion to be brazed. Assembly of one joint at a time using the prior art methods of resistance heating is a slow process. Because frames made of the nickel-bronze alloy of the invention can be strengthened by heat-aging, the entire frame assembly can be brazed at a controlled temperature; multiple joints being brazed by heating the frame in a fixture and strength lost by partial annealing, which can occur at brazing temperatures, can be regained by subsequent heat-aging. Resistance heating methods can also be used in the brazing step. The process of the invention results in a frame having substantially increased tensile strength and greater resistance to the acquisition of a permanent set than prior art frames. This is because the metal at the brazed joint is significantly stronger than the strength of brazed joints made according to the resistance brazing methods of the prior art utilizing non-heat-aging materials such as nickel-silver (copper-nickel-zinc), Monel (copper-nickel) and nickel. The time cycles of the brazing process can be adjusted to provide a satisfactory resistance heating brazed joint without concern to prevent over-heating in the area being brazed. Overheating during resistance heating brazing would result in weakening the joint area of frames of the prior art.

The heat-treatable nickel-bronze alloys of the invention are more fully described in U.S. Pat. Nos. 1,816,509 and 1,928,747, hereby incorporated by reference, and in two articles in the transactions of the American Institute of Metallurgical Engineers, AIME 1933, Volume 104, pages 221–249 and AIME 1934, Volume 111, pages 218–244, both of which are hereby incorporated by reference. The alloys comprise, in main percentage, copper nickel and tin with minor percentages of manganese or titanium either alone or with a small amount of magnesium. These minor ingredients are desirable to provide good ductility for cold working and are present, for instance, as a manganese proportion of about 1 percent to about 5 percent of the nickel content of the alloy. Small amounts of iron, lead, aluminum or silicon can also be present in the alloy without adversely affecting the ductility and heat-treatable nature of the alloy but these components should not ordinarily exceed about 1 percent, as a combined proportion of the total alloy composition. Zinc can also be present as an optional ingredient to reduce the cost of the alloy. Generally, the proportion of zinc utilized should not be greater than 10 percent of the total alloy.

The alloy can be formed by melting the materials together and casting the resulting alloy in ingots. If desired, the molten alloy can be heated substantially above its melting temperature and poured into ingots at this temperature. The ingots are annealed to produce a soft metal by heating for a prolonged period at a temperature of about 600° C to about 950° C depending upon the nickel and tin content of the alloy, the higher temperatures being required in alloys containing a high proportion of nickle. Annealing is followed by rapid cooling as by quenching in water or oil. The alloy is then ready for working such as by drawing into wire suitable for use in the production of spectacle frames. During the process of drawing of the alloy, it can be desirable to soften the work-hardened alloy by annealing at elevated temperatures as above to overcome the hardening effect of the drawing operation and make further reduction of the drawn area more easily accomplished. The alloy in the form of drawn wire used to assemble spectacle frames is generally solution annealed after the cold working of the alloy to produce the required wire shape and dimensions.

The proportion by weight of nickel and tin in the alloy is about 3 percent to about 26 percent nickel and about 2 percent to about 10 percent tin, preferably about 4 to about 12 percent nickel and about 2 to about 8 percent tin. The balance of the alloy composition to make 100 percent total can be copper less small percentages of manganese or titanium either alone or with magnesium as described above for good ductility, small amounts of impurities such as iron, lead, aluminum or silicon and up to about 10 percent zinc to reduce cost.

An additional advantage of the process of the invention is that the extent and cost of production tooling where induction or furnace heating methods are used can be significantly less than is required in the resistance brazing processes of the prior art. This is because the process is adapted to the use of only one fixture to accommodate all frame joints as opposed to the need to provide individual fixtures for each joint as is required in the production of spectacle frames utilizing resistance heating and non-heat-treatable metals such as nickel, Monel or nickel-silver alloy compositions.

In the prior art process of producing spectacle frames, it is customary to cold work the frame components to effect a reduction in area of between about 10 to about 75 percent. This process results in a certain degree of hardening of the frame material such that the tensile strength of the material used is increased. In accordance with the process of the present invention, a similar degree of cold working is utilized in the production of frames utilizing a nickel-bronze alloy which can be hardened by heat-aging.

The assembly of the spectacle frames is accomplished by brazing the spectacle frame joints using a brazing material selected from those materials which melt at a temperature of about 600° C to about 850° C such as a brazing alloy containing about 10 to about 80 percent by weight silver and the balance principally copper and zinc, an alloy containing 15 percent silver, 5 percent phosphorous and 80 percent copper (all by weight) or an alloy containing 45 percent silver, 15 percent copper, 16 percent zinc, and 24 percent cadmium (all by weight). While the required heat for such brazing operation can be provided by any suitable method such as by resistance heating, it is particularly desirable to utilize induction or furnace heating methods and braze all joints at the same time in the process of the present invention since any partial annealing which can occur during the brazing step utilizing the age-hardenable copper alloy of the invention according to the process of the invention can be compensated for subsequent to the brazing operation by aging the frame generally at a temperature of from about 200° C to about 550° C for about ¼ hour to about 12 hours to strengthen the assembled frame. Preferably, aging is accomplished at a temperature of about 300° C to about 450° C for about 1 hour to about 6 hours. The frame after such heat-aging treatment has a substantially higher tensile strength after such age hardening than the frame had subsequent to the brazing operation in which the heat used can tend to partially anneal or soften the frame wire. Preferably, the heat-aging treatment is conducted at a temperature of about 325° C to about 400° C for about 3 hours to about 5 hours.

The following examples illustrate the various aspects of the invention but are not intended to limit it. Where not otherwise specified throughout the specification and claims, temperatures are given in degrees Centigrade and parts are by weight.

EXAMPLE 1

A spectacle frame is prepared by utilizing 0.128 inch diameter wire prepared from a copper-containing alloy containing 85 percent copper, 9 percent nickel and 6 percent tin to produce a spectacle frame. The wire was reduced in area 40 percent by cold working prior to assembly of the frame. The parts of the frame such as the eyewire, bar, endpiece and brace are assembled in a fixture subsequent to solution annealing at 720° C for 30 minutes and the parts in their proper position are brazed using a brazing alloy consisting of 45 percent silver, 15 percent copper, 16 percent zinc and 24 percent cadmium by subjecting the entire frame to induction heating so that the frame is heated to a temperature of 720° C over a period of 5 minutes. The tensile strength of the frame parts after solution annealing are thereby reduced substantially over that of the frame parts prior to annealing. The tensile strength of the frame prior to annealing being about 95,000 psi and the tensile strength of the frame subsequent to annealing and brazing being 60,000 psi. The spectacle frame after brazing is hardened by subjecting it to an heat-aging step in which the frame is strengthened by exposure to a temperature of 344° C for 4 hours. The tensile strength is increased to a value of 125,000 pounds per square inch subsequent to the heat-aging step. The heat-aged spectacle frame is then provided with a finishing treatment in which the frame is polished and electroplated so as to provide a suitable finished spectacle frame.

EXAMPLE 2

Using the same alloy and following the same procedure as in Example 1, a spectacle frame is produced from parts which are solution annealed and then subjected to a brazing step by heating the frame parts in a furnace at a temperature of 720° C for 5 minutes. The frame is subsequently heat-aged at a temperature of 344° C for 4 hours resulting in a frame having a tensile strength subsequent to the brazing step of approximately 125,000 pounds per square inch.

EXAMPLES 3, 4 and 5

Following the same procedure as in Example 1 but using a copper alloy containing (by weight) 5 percent nickel, 5 percent tin and 90 percent copper (Example 3), a copper alloy containing (by weight) 85 percent copper, 7 percent nickel and 8 percent tin (Example 4) and a copper alloy containing 89 percent copper, 9 percent nickel and 2 percent tin (Example 5), spectacle frames are prepared. Tensile strength values of the brazed frames are increased over the values obtained after brazing by heat-aging as in Example 1. The tensile strength of the finished frame exceeds the value of the starting materials.

EXAMPLE 6

A spectacle eyewire frame (front portion) was prepared starting with a 0.128 inch diameter wire reduced by cold working to an appropriate cross section 40 percent of the original area. A copper-containing alloy wire containing 85 percent copper, 9 percent nickel and 6 percent tin was used. The frame parts were solution annealed at 720° C for 30 minutes and then assembled by brazing using electrical resistance heating in which alternating current is passed through the joint to be assembled. The resistance to the passage of current at the contact points provides the required heat for the brazing step. The brazing alloy used contained 45 percent silver, 15 percent copper, 16 percent zinc, and 24 percent cadmium. The tensile strength of the frame was substantially increased from a solution annealed strength of 60,000 psi to a tensile strength of 125,000 psi by heat-aging the assembled frame at a temperature of 344° C for 4 hours.

EXAMPLE 7

(Control: Forming No Part of This Invention)

A spectacle eyewire frame (front portion) was prepared starting with 0.128 inch diameter wire which was subjected to cold working to provide a 40 percent reduction in area. The alloy has a composition by weight of 72 percent copper, 15 percent nickel, and 13 percent zinc and is known in the art as nickel silver or german silver. The frame was assembled by using heat supplied by resistance heating as in Example 6. The brazing alloy was the same as in Example 1. The frame had a tensile strength after assembly of 55,000 psi. No heat-aging of the assembled frame was performed since it is known that nickel silver alloys are not increased in strength thereby.

We claim:

1. In a process of making spectacle frames with high tensile strength and good resistance to permanent set of frame from a plurality of parts by brazing, the improvement comprising, preparing a precursor alloy shape capable of subsequent working to make spectacle frame parts, said shape characterized by softness and being of a nickel bronze alloy, the alloy consisting essentially of about 2–10 percent tin, from about 3–26 percent nickel, with the rest being copper, there being minor amounts of manganese to impart ductility to the alloy, and less than about 1 percent of other elements, said shape having been rendered soft by subjecting the alloy thereof to prolonged heating in the range of about 600° C. to about 950° C. for a time period sufficient to obtain the easily workable soft condition, forming a part of a spectacle frame from said alloy in the course of which said shape is reduced on the order of 10–75 percent in area to thereby impart cold working characteristics and thus some hardening to the frame part being made, brazing said part to another of said plurality of parts, heating said frame part to age it at a temperature in the range of about 300° C. to about 450° C. for about 1 to 6 hours in order to promote precipitation of a phase in the alloy, which phase is characterized by the chemical formula $Ni_2Sn$, to thereby obtain a spectacle frame part characterized by high tensile strength and good resistance to permanent set.

2. The process of claim 1 wherein said alloy comprises by weight 9 percent nickel and 6 percent tin.

3. The process of claim 1 wherein said alloy comprises by weight 5 percent nickel and 5 percent tin.

4. The process of claim 1 wherein said alloy comprises by weight 7 percent nickel and 8 percent tin.

5. The process of claim 1 wherein said alloy comprises by weight 9 percent nickel and 2 percent tin.

* * * * *